United States Patent [19]

Clishem et al.

[11] 4,362,686

[45] Dec. 7, 1982

[54] COLLAPSIBLE CORE AND METHOD OF USING SAME

[75] Inventors: Thomas A. Clishem, Louisville, Ky.; Melvin L. Neville, Jeffersonville, Ind.; Leonard W. Pokallus, Louisville, Ky.

[73] Assignee: Corning Glass Works, Corning, N.Y.

[21] Appl. No.: 218,667

[22] Filed: Dec. 22, 1980

[51] Int. Cl.[3] ..... B28B 1/14; B28B 7/20

[52] U.S. Cl. ..... 264/317; 164/132; 249/62; 249/63; 249/134; 249/135; 249/175; 264/332

[58] Field of Search ..... 164/132, 138; 249/175, 249/178, 106, 135, 61–63, 122, 177, 134; 65/305, 357; 425/DIG. 12, DIG. 14; 264/317, 332, 334

[56] References Cited

U.S. PATENT DOCUMENTS

| | | | |
|---|---|---|---|
| 1,683,475 | 9/1924 | Littell | 164/132 |
| 1,698,308 | 1/1929 | Lemcke | 249/63 |
| 1,929,842 | 10/1933 | Forster | 65/305 |
| 1,946,451 | 2/1934 | Bailey | 249/106 |
| 1,948,653 | 2/1934 | Emery et al. | 249/63 |
| 1,993,438 | 3/1935 | Flammang et al. | 249/63 |
| 2,004,378 | 6/1935 | McMullen | 264/317 |
| 3,506,235 | 4/1970 | Katz et al. | 249/82 |
| 3,940,102 | 2/1976 | Bedell | 249/63 |

*Primary Examiner*—Willard E. Hoag
*Attorney, Agent, or Firm*—Richard N. Wardell

[57] ABSTRACT

Thermally collapsible core of three to five solid carbonaceous segments of generally equal volume and of wedge-like shape arranged around a collapse axis of the core in narrowly spaced apart relation to each other. Core includes spacers occupying a minor portion of the narrow spacing nearest the external periphery of the core and which are made of metal, glass, ceramic or mixtures thereof having a melting point below the highest temperature to which the core is subjected by molten material solidifying therearound, e.g. fusion-cast refractory. The segments are the larger parts of the core. Heat transferred from solidified molten material to core causes spacers to melt and allow segments to collapse inwardly toward collapse axis to accommodate cooling shrinkage of casting without cracking. Melted spacers can drain downwardly out of core. Design yields highly quenched microstructure in fusion-cast refractory, which is especially beneficial in tap hole blocks for steelmaking furnaces and vessels.

11 Claims, 5 Drawing Figures

COLLAPSIBLE CORE AND METHOD OF USING SAME

BACKGROUND OF THE INVENTION

A variety of core-molding techniques have been employed for manufacturing cast products from molten materials. The Background section and the claimed invention of U.S. Pat. No. 3,940,102 outline several such techniques involving, respectively, collapsible and withdrawable cores in the manufacture of hollow fusion-cast refractories. Another collapsible coring technique for fusion-casting of molten carbide or oxide materials analogous to fusion-cast refractories is shown in U.S. Pat. No. 3,506,235. Collapsible and withdrawable cores are also known for the manufacture of hollow metal castings, e.g. see U.S. Pat. Nos. 1,946,451, 1,698,308 and 1,683,475. Withdrawable cores are even known for manufacturing glass articles from molten glass as shown in U.S. Pat. No. 1,929,842.

The general problem requiring such specialized coring techniques involves the fact that cracking or hot tearing occurs in a cooling solidified casting as it shrinks around and onto a core that does not collapse or is not withdrawn to accomodate such cooling shrinkage of the solidified casting and to avoid the resultant detrimental strain in such casting. Since fusion-cast refractories (of nonmetallic oxides, carbides, borides and the like) are generally much more brittle materials than cast metals, the problem is especially acute with such refractories.

In recent years, single-piece tap hole blocks for steel-working furnaces and vessels have been made as some of the more notable hollow fusion-cast refractory products. Commonly these articles have been made with collapsible cores of baked, organic-bonded refractory grain. Those cores fail to give adequate highly quenched microstructure of fine interlocking crystals in the refractory solidified around them. They also tend to cause interconnecting porosity in such refractory as a result of gases given off from those cores when their organic bond becomes highly heated by the surrounding solidifying refractory. In fabrication these cores are semi-fused to the refractory which requires expensive diamond drilling resulting in exposure of said porosity. These dificiencies, in particular the exposed porosity, significantly limit the service life of the blocks under the severely abrasive, erosive and corrosive environment of thousands of tons of molten steel passing through their orifices. Thus, a strong need existed for making the fusion-cast blocks, at least in those portions forming and underlying the orifice surfaces, with a highly quenched microstructure and a very dense macrostructure.

Conceptually the meltable metal cores of U.S. Pat. No. 2,004,378 may seem to provide adequate mass and heat capacity to absorb heat from molten refractory contacting them so as to yield the needed quenched, dense structure in the adjacent solidified refractory prior to melting of such core. However, as a practical matter such cores are not always able to commercially provide the needed saleable hollow fusion-cast refractory product because of several key factors. Sizes are restricted because of the economic consideration of the material of core construction and by the critical requirement of balancing the mass of the core to the mass of fusion-cast refractory so that the core either melts too soon thereby leading to "break-out" of molten refractory into the core space or does not adequately melt causing strain and cracking of the fusion-cast article. Very importantly involved with solid metallic cores in extreme high tempertaure applications is the detrimental effect of possible stream impingement upon the core resulting in premature melting of certain areas of the core thus yielding a defective non-saleable final product. Thus, there are cases where the required core size and the required fusion-cast refractory size are not compatible for making a useful product.

The withdrawable graphite core of U.S. Pat. No. 3,940,102 provided adequate mass and heat absorbing capacity for producing the needed dense quenched structure, but it was found to be awkward and non-economical to commercially operate consistently at the right time to avoid cracking of the fusion-cast refractory.

Employment of many separate core segments, individually of small mass and spaced around a central column as shown in U.S. Pat. No. 1,946,451, generally have inadequate heat absorbing capacity such that these cores - whether of metal or even graphite - would fail to produce adequate depth of highly quenched microstructure in the fusion-cast refractory product and/or would be damaged by interaction with the cooling solidified refractory surrounding them, which interaction would also likely damage or contaminate such refractory. With segments of small mass the possibility of violent reactions when in intimate contact with certain molten materials is significantly increased resulting in compromise of safety and/or an unsaleable product.

SUMMARY OF THE INVENTION

The new invention described herein involves the discovery of an economical thermally collapsible core with carbonaceous type segments of adequate mass and heat absorbing capacity to provide the highly quenched microstructure and dense macrostructure in the hollow fusion-cast body formed around it and also prevent the possibility of core-molten material violent reaction. Additionally the invention provides a means of avoidance of localized core melting and the results thereof caused by stream impingement. It is especially applicable in the manufacture of hollow fusion-cast refractory articles, although it could be used in casting articles of other solidified molten materials.

The new thermally collapsible core for a molten material casting mold comprises three to five (desirably four) solid carbonaceous segments, each of generally equal volume and of the special shape described below, which constitute first larger parts of the core that will not melt nor violently react at the highest temperature to which the core is subjected, and spacers constituting second smaller parts of the core formed of metal, glass, ceramic or mixtures thereof having comparatively low melting point relative to the aforesaid highest temperature (i.e. a melting point sufficiently below that highest temperature so as to result in complete melting of the spacers upon the occurrence of that highest temperature), which spacers are specially positioned between the carbonaceous segments as described below. Carbonaceous material is recognized as carbon, semi-graphite, grahite or combinations thereof.

Each carbonaceous segment is shaped to have a periphery-defining side area and two mating side areas that are collectively joined to define the entire side areas of the segment extending between opposite ends of the segment and of the core. The periphery-defining side areas of all of the segments collectively define the external periphery of the core. The two mating side areas of each segment intersect at a common mating edge of the segment. That mating edge is adjacent and parallel to, but immediately spaced from, the corresponding mating edge of each of the other segments, thereby defining a collapse axis centrally between and parallel to those mating edges. Each mating side area of each segment is narrowly spaced from an adjacent mating side area of an adjacent segment in a manner allowing the segments to collapse together toward the collapse axis with all of the mating edges converging or coming together at that axis.

Each spacer is positioned so as to occupy a portion of the narrow space between adjacent mating side areas of adjacent segments, which portion begins at the external periphery of the core and extends inwardly a minor part of the perpendicular distance between the external periphery and the collapse axis. Such portion also extends fully between the aforesaid opposite ends of the segments and of the core.

The invention also comprises providing the thermally collapsible core described above in, and as a step of, the process of fusion casting refractory. Such improved process comprises additionally the customary steps of casting molten refractory into the mold cavity of a mold having at least one thermally collapsible core extending into the mold cavity from a surface of the mold at least partially defining the cavity and then solidifying the cast molten refractory therein to form fusion-cast refractory article with a hollow portion formed by the core. In such method, it is also desirable that, upon melting of the spacers by heat transferred to the core from the molten refractory solidified therearound, the melted spacer material is allowed to drain out of the core into a catch basin below the mold. Lastly, the carbonaceous segments are allowed to collapse together upon cooling shrinkage of the solidified refractory surrounding the core. At this stage of the process the option exists of allowing the carbonaceous portion to remain in situ to further extract heat from the casting and enhance attributes, or may be removed to provide access for external auxiliary cooling of the hollow portion of the casting. Under both options reuse of the carbonaceous portion of the core provides additional economic benefit.

This invention in contrast to previous teachings has the additional benefit of obvious economic advantage in commercial fabrication of useful products.

DETAILED DESCRIPTION

Figure 1:
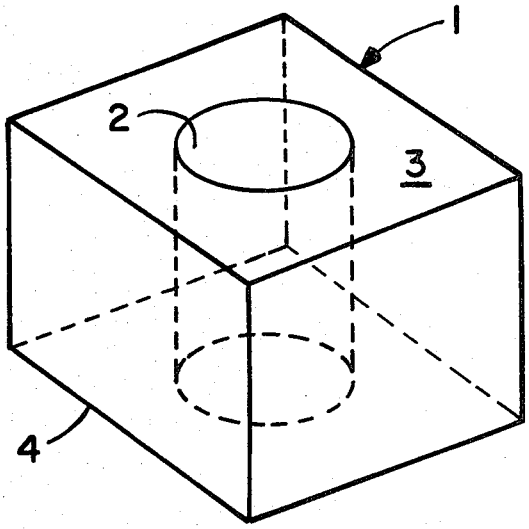
FIG. 1 is a perspective view of a typical fusion-cast refractory tap hole block formed with apparatus as shown in the other figures of the drawings.

The tap hole block 1 shown in FIG. 1 has an orifice 2 extending through the block and open at the opposite faces 3, 4 of the block. Such block for steelmaking uses is usually made of periclase-chrome spinel type of fusion-cast refractory, although such hollow cast articles can also be made of any other suitable composition of fusion-cast refractory, e.g. high (80–90 wt. %) MgO type, high $Al_2O_3$ type or alumina-zirconia-silica type. Other hollow fusion-cast articles can be made of nonoxide (carbide, boride, etc.) type of compositions.

Figure 2:
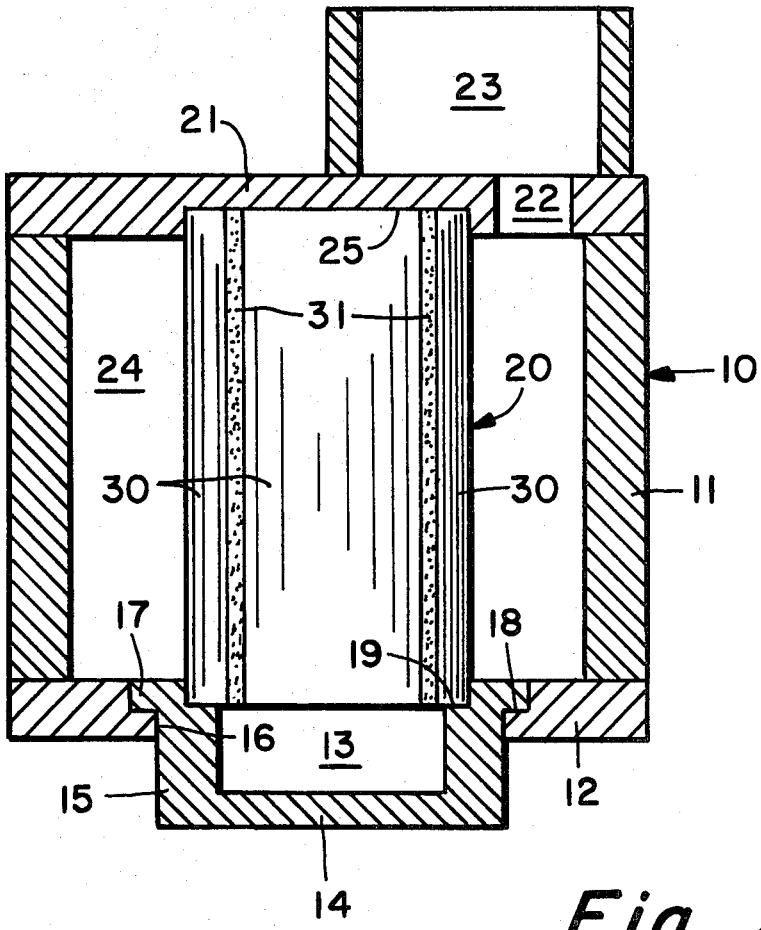
FIG. 2 is a side sectional view of one form of fusion casting apparatus incorporating a thermally collapsible core of the present invention and in position ready for casting molten refractory therein.

In FIG. 2, the mold 10 comprises side slabs 11 positioned on and around the periphery of bottom slab 12. A catch basin 13 is mounted on the bottom of mold 10. Basin 13 comprises a bottom 14 and side 15, and it is fitted into opening 16 in bottom slab 12. Basin side 15 has an upper flange 17 which fit into the shoulder or notch 18 in bottom slab 12 at the upper part of opening 16. Flanges 17 and notch 18 coact to hold basin 13 in place on the bottom of mold 10.

Thermally collapsible core 20 is preferably keyed into the basin 13 by means of the shoulder or notch 19 in the upper part of the basin. This keying prevents movement of the core during casting of the molten refractory into the mold.

Mold 10 usually also has a cover slab 21 positioned on top on side slabs 11. Cover slab 21 has a mold gate 22, and the font or pour basin 23 is positioned on top of cover slab 21 surrounding gate 22.

The mold components, including basin 13 and font 23 can be of any suitable refractory materials for containing the molten materials that contact them. It is preferred to make them all of graphite.

In the process of fusion casting, molten refractory is poured into font 23 and through gate 22 into the mold cavity 24 generally defined by the mold slabs 11, 12 and 21. The molten refractory fills the cavity 24 and surrounds the core 20, solidifying onto and around the core 20 with a highly quenched structure.

To further insure maintenance of the desired position of core 20 in mold 10 during casting, the upper end of core 20 is keyed into recessed area 25 in the lower side of the cover slab 21. Of course, when the desired hollow for a fusion-cast refractory does not extend all the way through such refractory, the core 20 will correspondingly not extend all the way up to cover slab 21, leaving cavity 24 to extend over the top end of core 20.

Core 20 may have any desired regular or irregular external geometry consistent with the basic requirements of segment shape and spacer positioning as described above. For example, the core may be prismatic instead of cylindrical, or it may have laterally bulged or enlarged portions along its vertical height in accordance with any desired shape of hollow in the fusion-cast refractory article.

Figure 3:
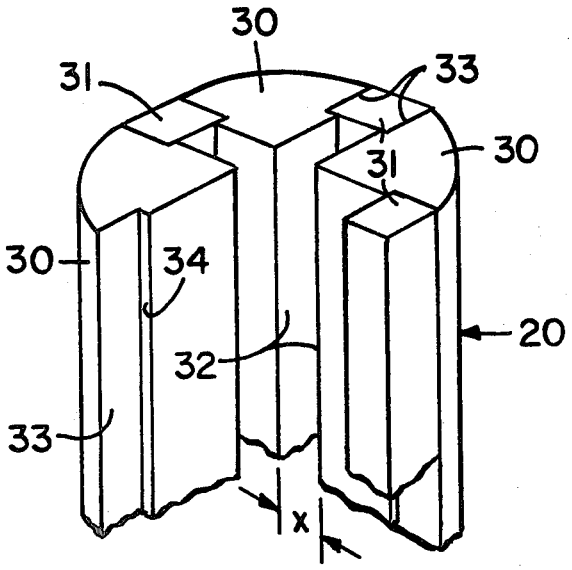
FIG. 3 is a fragmentary perspective view of one embodiment of a thermally collapsible core according to the present invention.

The new thermally collapsible core 20 will be best understood by reference to FIG. 3 in conjunction with FIG. 2. Core 20 is the preferred QUARTER CUT core having four segments 30 of the carbonaceous material graphite of equal shape and size. These segments are easily and economically formed by cross slicing a rod or bar of graphite into the four pieces or segments. Spacers 31 are alternatively positioned between segments 30 to hold the adjacent mating side areas or surfaces 32 of adjacent segments narrowly spaced apart. To facilitate proper positioning of spacers 31 to have one of their surfaces flush with the surfaces of segments 30 defining the external periphery of core 20, mating surfaces 32 have a recessed area 33 extending inwardly and ending in shoulder 34. The inward depth of area 33 corresponds to the dimension of each spacer extending inwardly from the external core periphery. The spacer 31 is not restricted to a solid cross sectional area but could be of various geometric designs such as tubes, flattened tubes, "U" shape, etc.

Mating surfaces 32 of each segment intersect at an inward edge centrally within the core, which edge is referred to as a mating edge. The mtaing edges of all four segments are adjacent and parallel to, but immediately spaced from, each other. Collectively, those mating edges define a collapse axis centrally between and parallel to all of those mating edges.

The inwardly extending dimension of each spacer constitutes a minor portion of the perpendicular distance between the external periphery of the core and the collapse axis.

The total collapse void (i.e. the collective narrow spacing between segments 30) for casting shrinkage allowance will vary with geometric shape factors of the fusion-cast product, but it should at least be equal to the volume required to accomodate such shrinkage. Preferably such void volume is 30–50% greater than such minimum equal requirement.

For proper chill or quenching of the solidified molten refractory, each segment is much larger than each spacer. The volume of spacers as a percentage of the volume of segments may vary depending upon composition of cast molten material and spacers, geometric shape of casting and core, etc. Successful castings have been fabricated with this volume percent varying from about 1% to about 20% with this range being a function of the casting geometry involved, e.g., mold cavity vs. core diameter.

As molten refractory in mold 10 solidifies onto and around core 20 to form a self-sustaining thickness, the spacers 31 will melt and flow downward into basin 13 for collection and reuse. Upon that occurrence, the shrinking solidified refractory causes the segments 30 to collapse together toward the collapse axis. After removing the fusion-cast article from mold 10, the segments 30 can be withdrawn from the article and reused.

Figure 4:
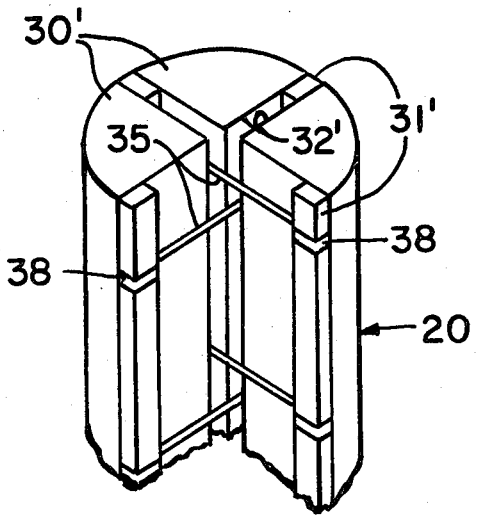
FIG. 4 is a fragmentary perspective view of another embodiment of a thermally collapsible core according to the present invention.
Figure 5:
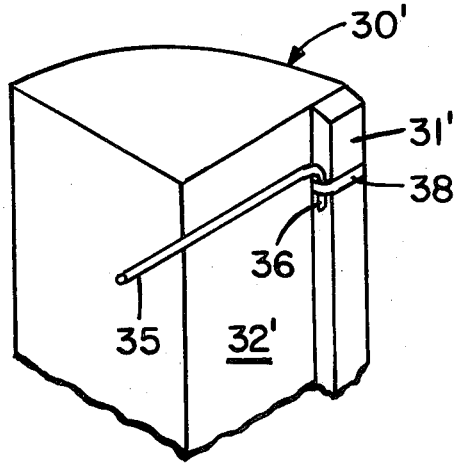
FIG. 5 is a fragmentary perspective view of a detailed portion of the embodiment of FIG. 4.

FIG. 4 shows an alternative means of positioning spacers 31' between mating surfaces 32' of segments 30'. Diametrically opposite spacers 31' are joined or linked together by at least a pair of suitable tie rods 35. As better shown in FIG. 5, the outer ends 36 of tie rods 35 are bent to lie along the inner sides of spacers 31'. Those ends 36 can be fastened to spacers 31' by an suitable means, such as a strip of common adhesive tape 38 wrapped therearound.

The spacers and tie rods (if used) are made of any suitable low melting material. Metals of high thermal conductivity, such as copper and brass, work very well. Also, ceramic and/or glass materials, such as common window or soda-lime glass, provide more economical spacers with good performance in conjunction with fusion-cast refractory having typical casting temperature of the molten refractory in the range of 1700°–2600° C.

For providing more finely controlled timing of thermal transfer between solidified refractory and core along with correlated melting of the spacers, thin coatings may be applied over the external periphery of the core to alter its emissivity characteristics. For example, zircon based compositions or molybdenum disilicide have been advantageously used as much coatings. They can be applied in any suitable manner, e.g. slurry or paste coating baked or air dried, flame sprayed, etc.

As a specific example of the invention, a tap hole block 18×18×15 inches with a 10 inch diameter orifice or core hole of excellent quenched structure was made of periclase-chrome spinel fusion-cast refractory. The molten refractory had a temperature of about 2300°–2500° C. upon being poured into the mold having the new core with copper spacers. The area of the gate was 15 square inches and the font volume was 1728 cubic inches. The core had a pre-collapsed outside diameter of 10 inches. The width of collapse space between adjacent mating surfaces was 0.375 inch. The spacers had a width between adjacent recessed areas 33 (as in FIG. 3) of 0.50 inch and a depth inward from the external periphery to shoulders 34 of 1.0 inch. The core being orientated in such a manner to preclude mold stream impingement upon spacers 31 during casting and mold cavity 24 filling. To further demonstrate, by this specific example, products of the above description are being fabricated according to this invention in a production environment and yielding saleable product at the level of 90% selection while the same specific size using standard acceptable metal casting coring techniques produced quality ware at an unacceptable 30% level.

Other good quality tap hole blocks of the same fusion-cast refractory composition and of high MgO compositions were made in varying sizes ranging from 2×2×2 inches to 18×18×21 inches with orifice diameters ranging between 0.5–7 inches. The dimensions of core segments and spacers for these articles of various sizes were proportioned accordingly.

What is claimed is:

1. In the process of fusion casting refractory comprising casting molten refractory into the mold cavity of a mold having at least one thermally collapsible core extending into the mold cavity from a surface of the mold at least partially defining the cavity and then solidifying the cast molten refractory therein to form a fusion-cast refactory article with a hollow portion formed by the core, wherein the improvement comprises providing, as the thermally collapsible core, the core of claim 6 said casting being at a tempertaure sufficient to melt said spacers, and causing the segments to move so that all of the mating edges converge toward the collapse axis to permit removal of the segments from the cast refactory.

2. The process of claim 1 wherein, upon melting of the spacers by heat transferred to the core from the molten refractory solidified therearound, the melted spacer material is allowed to drain out of the core into a catch basin below the mold.

3. The process of claim 1 wherein the spacers are formed of metal consisting essentially of copper.

4. The process of claim 1 wherein the spacers are formed of glass, ceramic and mixtures thereof.

5. The core of claim 1 wherein a thin covering for altering emissivity characteristics of the core is applied over the external periphery of the core.

6. A collapsible core for a molten material casting mold comprising first parts which will not melt at the highest temperature to which the core is subjected and which are spaced apart by second parts of comparatively low melting point relative to said highest temperature, wherein the improvement comprises the first parts being three to five segments of carbonaceous material selected from the group consisting of carbon, semi-graphite, graphite and combinations thereof, each of generally equal volume, and being the larger parts of the core, each segment having a periphery-defining side area and two mating side areas collectively joined and defining the entire side areas of the segment extending between opposite ends of the segments and of the core, the two mating side areas of each segment intersecting at a common mating edge of the segment which is adjacent and parallel to, but immediately spaced from, the corresponding mating edge of each of the other segments, thereby defining a central hollow space and a collapse axis centrally between and parallel to those mating edges, each mating side area of each segment being narrowly spaced from an adjacent mating side area of an adjacent segment in a manner allowing all of the segments to collapse together toward the collapse axis with all of the mating edges converging together at that axis, the second parts being spacers equal in number to the segments and formed of metal, glass, ceramic or mixtures thereof having said low melting point, and being the smaller parts of the core, and each spacer occupying the narrow space between adjacent mating side areas of adjacent segments from the external periphery of the core inwardly a minor portion of the perpendicular distance between the external periphery and the collapse axis, periphery - defining side areas of all of the segments and adjacent said spacers collectively defining the external periphery of the core.

7. The core of claim 6 wherein the spacers are formed of metal consisting essentially of copper.

8. The core of claim 6 wherein the spacers are formed of glass, ceramic or mixtures thereof.

9. The core of claim 6 wherein there are four segments of carbonaceous material of identical shape and size.

10. The core of claim 6 wherein a thin covering for altering emissivity characteristics of the core is applied over the external periphery of the core.

11. A mold assembly for casting molten material comprising joined top, bottom an side walls defining a mold cavity and a collapsible core disposed in the mold cavity, the core comprising first parts which will not melt at the highest temperature to which the core is subjected and which are spaced apart by second parts of comparatively low melting point relative to said highest temperature, wherein the improvement comprises the core being the core of claim 6, and the inner surfaces of the top and bottom walls facing the mold cavity each having a recess into which an opposite end of the core is keyed.

* * * * *